US005765765A

United States Patent [19]

Tamura et al.

[11] Patent Number: 5,765,765

[45] Date of Patent: Jun. 16, 1998

[54] METHOD OF AND APPARATUS FOR DRIVING A CRUSHING MACHINE

[75] Inventors: Yukio Tamura; Toshio Kitani; Satoru Koyanagi; Toru Nakayama; Katsuhiro Ikegami; Yuji Ozawa, all of Kawasaki, Japan

[73] Assignee: Komatsu Ltd., Tokyo, Japan

[21] Appl. No.: 765,840

[22] PCT Filed: Aug. 2, 1995

[86] PCT No.: PCT/JP95/01538

§ 371 Date: Jan. 14, 1997

§ 102(e) Date: Jan. 14, 1997

[87] PCT Pub. No.: WO96/04075

PCT Pub. Date: Feb. 15, 1996

[30] Foreign Application Priority Data

Aug. 4, 1994 [JP] Japan ..... 6-183423

[51] Int. Cl.[6] ..... B02C 25/00

[52] U.S. Cl. ..... 241/27; 241/29; 241/36; 241/101.74

[58] Field of Search ..... 241/33, 36, 236, 241/27, 101.74, 29

[56] References Cited

U.S. PATENT DOCUMENTS

| | | | |
|---|---|---|---|
| 3,868,062 | 2/1975 | Cunningham et al. | 241/36 |
| 4,034,918 | 7/1977 | Culbertson et al. | 241/36 |
| 4,452,400 | 6/1984 | Williams | 241/36 |
| 4,560,110 | 12/1985 | Burda | 241/36 |
| 4,609,155 | 9/1986 | Garnier | 241/30 |
| 5,186,398 | 2/1993 | Vigneaux, Jr. | 241/33 |

FOREIGN PATENT DOCUMENTS

| | | |
|---|---|---|
| 56-46943 | 11/1981 | Japan . |
| 60-43777 | 9/1985 | Japan . |
| 64-32744 | 3/1989 | Japan . |
| 2-303550 | 12/1990 | Japan . |
| 4-190858 | 7/1992 | Japan . |

*Primary Examiner*—John M. Husar

*Attorney, Agent, or Firm*—Frishauf, Holtz, Goodman, Langer & Chick

[57] ABSTRACT

A method of driving a dual axis shearing type crushing machine mounted on a self-traveling vehicle body for crushing crushable building scraps at a building wrecking site. The crushing machine includes a pair of rotary shafts provided with a plurality of cutters within a housing on the vehicle body. The rotary shafts are supported sidelong so as to be concurrently rotatable, and the crushing machine also includes a scraper attached to an inner surface of the housing on the vehicle body so as to oppose the cutters and the rotary shafts. The method includes the steps of: (a) rotating the pair of rotary shafts in a forward direction for a first predetermined time duration so that the cutters crush the crushable building scraps into crushed pieces; (b) thereafter rotating the pair of rotary shafts in a reverse direction for a second predetermined time duration so that the crushed pieces are drawn into and trapped in a spacing provided between the scraper and the cutters and the rotary shafts at an outlet side of the crushing machine within the housing; and (c) continuously repeating the steps (a) and (b) in succession so as to consecutively crush the crushable building scraps into the crushed pieces and force the crushed pieces to be fed from the outlet side of the crushing machine out of the housing so as to enable the crushed pieces to be discharged onto a conveyor provided on the vehicle body without clogging of the crushed pieces in the spacing.

9 Claims, 6 Drawing Sheets

METHOD OF AND APPARATUS FOR DRIVING A CRUSHING MACHINE

TECHNICAL FIELD

The present invention relates to a method of and an apparatus for driving a crushing machine, such as a self-traveling crushing machine, that can be used to crush crushable scraps at a building wrecking site.

BACKGROUND ART

As disclosed in Japanese Unexamined Utility Model Publication No. Sho 64-32744, there has been known a self-traveling crushing machine vehicle in which a crushing machine, a hopper coupled to the said crushing machine and a drive unit for driving the said crushing machine are mounted on a vehicle body that is equipped with a pair of left hand side and right hand side self-traveling bodies and in which a discharge conveyer is mounted, so as to be capable of rising up and falling down, between the left hand side and right hand side self-traveling bodies in the pair on the lower part of the said vehicle body.

Such a self-travelling type crushing machine vehicle is capable of finely crushing a mass of crushable objects which are constituted by building scraps or the like which are charged into the hopper, and then discharging the crushed pieces out of the vehicle body by means of the discharge conveyer.

The above mentioned crushing machine of the said self-traveling crushing machine vehicle is provided with a fixed edge and movable edge and has a construction in which the said movable edge is oscillatingly swung towards the said fixed edge so that a crushable object may be squeezed between the said fixed edge and the movable edge and may then be crushed. Since the said fixed edge and the said movable edge are generally oriented vertically, the entire height of the crushing machine of this type needs to be large, thus requiring the said self-traveling crushing machine vehicle to be large in its entire height. This has involved a problem in that the said crushing machine is difficult to be transported with the self-traveling vehicle.

In an attempt to resolve such a problem, the present applicant has previously proposed an improved self-traveling crushing machine vehicle in which the vehicle body has a crushing machine of a dual axis shearing type mounted thereon that is comprised of a pair of rotary shafts which are provided with a plurality of cutters within a housing and are supported sidelong so as to be rotatable.

With such a self-traveling crushing machine vehicle, its entire height can be lowered since the crushing machine may be lowered in its entire height.

It has been found, however, that when light weight crushable objects such as straw mats, vinyl made products or paper made products are attempted to be crushed, they cannot drop or be discharged from the housing in spite of the fact that they are being continuously crushed.

When the cause of this phenomenon was zealously investigated by the present inventor, it has been found that when a crushing machine of a dual axis shearing type is used in which the discharge side of a pair of rotary shafts (that constitutes a crushing means) which are provided with a plurality of cutters, has a scraper attached thereto is opposed to said rotary shafts and said cutters, a crushable object tends to be pushed into and held within a spacing between the said scraper and the said rotary shaft and a spacing between the said scraper and the said cutter (i. e. a spacing between the crushing means and the scraper) and, as a result, the crushed pieces successively deposit or are piled up at the discharge side of the crushing means so that a failure in the drop and discharge of the crushed pieces may take place.

With the above mentioned problem taken into account, it is accordingly an object of the present invention to provide a method of and apparatus for driving a crushing machine whereby a situation in which crushed pieces deposit or are piled up at the discharge side of a crushing means so that they are unable to drop or be discharged is avoided, and whereby a crushing operation can be carried out with an enhanced efficiency.

SUMMARY OF THE INVENTION

In order to achieve the object mentioned above, there is provided in accordance with the present invention, in a first general embodiment thereof, a method of driving a crushing machine of a dual axis shearing type in which a pair of rotary shafts which are provided with a plurality of cutters within a housing are supported sidelong so as to be rotatable, the said pair of rotary shafts are adapted to be rotated concurrently and an inner surface of said housing has attached thereto a scraper that is opposed to said cutters and said rotary shafts each with a spacing, which method comprises the steps of:

a) normally rotating the said pair of rotary shafts for a first predetermined time duration;

b) thereafter reversely rotating the said pair of rotary shafts for a second predetermined time duration; and c) continuously repeating the steps a) and b) in succession, the said first predetermined time duration being set to be longer than the said second predetermined time duration.

According to a driving method as mentioned above in which a pair of rotary shafts are driven in a normal mode of rotation followed by a reverse mode of rotation iteratively, it will be seen that if the crushed pieces which are formed resulting from the crushing of a light weighted crushable object are pushed into and held within a spacing between a crushing means and a scraper, the said crushed pieces can be automatically discharged from the said spacing and that since a time duration for the said reverse mode of rotation is set to be shorter than a time duration for the said normal mode of rotation, a continuous crushing operation is made possible.

In order to achieve the object mentioned above, there is provided in accordance with the present invention, in a second general embodiment thereof, an apparatus for driving a crushing machine of a dual axis shearing type in which a pair of rotary shafts which are provided with a plurality of cutters within a housing are supported sidelong so as to be rotatable, the said pair of rotary shafts are adapted to be rotated concurrently by a drive source and an inner surface of said housing has attached thereto a scraper that is opposed to said cutters and said rotary shafts each with a spacing, which apparatus comprises:

a drive source control means of which a switch-over is capable of being effected among a first drive control section for normally rotating the said drive source, a second drive control section for reversely rotating the said drive source and a third drive control section for halting the said drive source;

a crushed pieces deposit detecting means for detecting that crushed pieces have been piled at the discharge side of the said pair of rotary shafts in the said housing; and a controller for having the said drive source control means constituted by the said first drive control section when an activation signal is furnished at an input thereof and having the said drive source control means constituted by the said second drive control section for a predetermined time duration when a crushed pieces deposit detecting signal is furnished at an input thereof.

According to a driving apparatus as mentioned above, it can be seen that since a pair of rotary shafts are automatically rotated reversely, when crushed pieces are piled or deposited at the discharge side of the crushing means, to discharge the crushed pieces which have been pushed into and held within the spacing between the crushing means that has been a cause of the pile or deposition and a scraper, the piled or depositing crushed pieces can be dropped and discharged effectively.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

BEST MODES FOR CARRYING OUT THE INVENTION

Hereinafter, a suitable embodiment of the present invention with respect to a method of and an apparatus for driving a crushing machine will be set forth with reference to the accompanying drawings hereof.

(The Entire Structure of a Self-Traveling Crushing Machine Vehicle)

Figure 1:
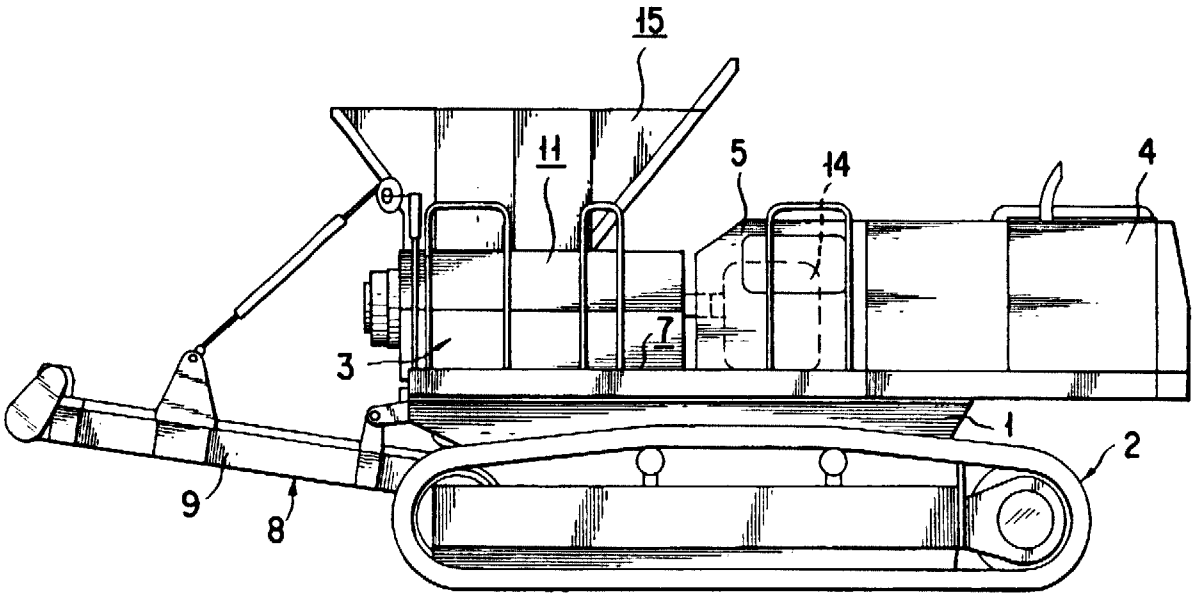
FIG. 1 is a front view of a self-traveling crushing machine vehicle that incorporates a certain embodiment of the crushing machine driving apparatus according to the present invention.
Figure 2:
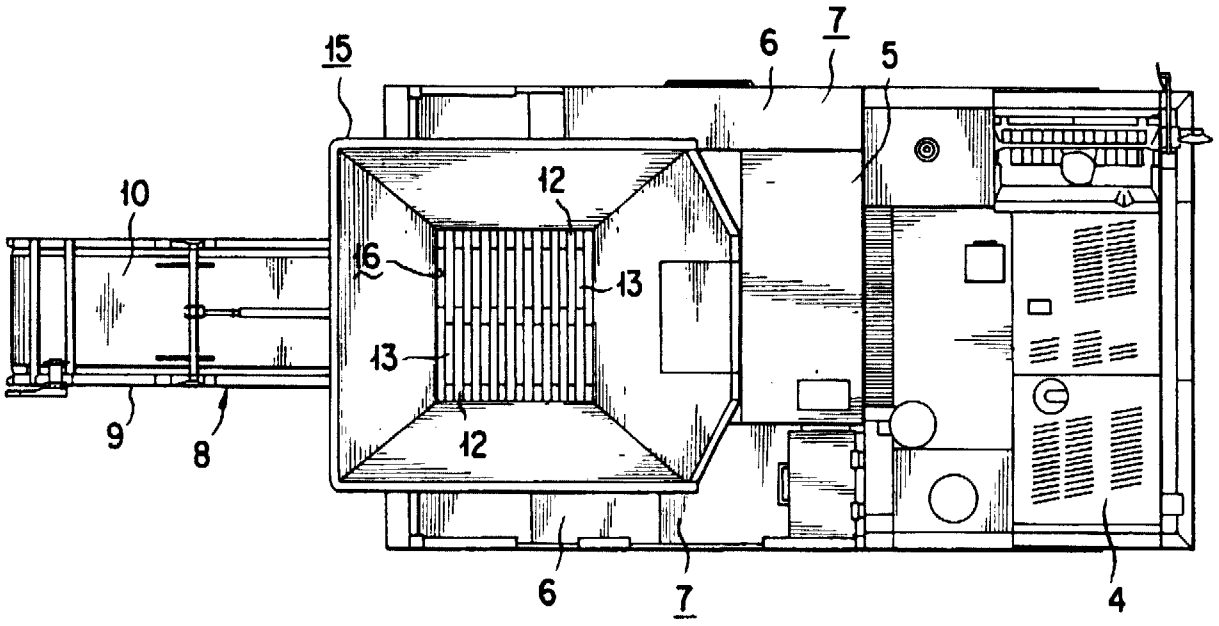
FIG. 2 is a top plan view of the above mentioned self-traveling crushing machine vehicle.

As shown in FIGS. 1 and 2, a vehicle body 1 has, at its right hand side and left hand side, a pair of right hand side and left hand side traveling bodies 2 appended thereto, respectively. A crushing machine 3 is mounted on the said vehicle body 1 at a site that is closer to one end in the forward and rearward direction thereof. Also, a cover 4 is mounted on the above mentioned vehicle body 1 at a site that is closer to the other end in the forward and rearward direction thereof, and a auxiliary cover 5 is mounted on the said vehicle body 1 at a central region in the forward and rearward direction thereof. Across the said auxiliary cover 5 and the said crushing machine 3 there lie a pair of step plates 6 at their right hand side and left hand side, respectively, and there also lie a pair of passages 7 at their right hand side and left hand side, respectively. Below the above mentioned vehicle body 1 there is provided a belt conveyer 8 between the said right hand side and left hand side traveling bodies 2 and 2 in the pair. The said belt conveyer 8 has a frame 9 with an endless belt 10 that is wound on a pair of pulleys (not shown) provided at the front and rear ends, respectively, and the said frame 9 is mounted to the lower part of the said vehicle body 1 so as to be capable of rising up and falling down.

The above mentioned crushing machine 3 is of a dual axis shearing type which has a multitude of cutters 12 within a housing 11 fixedly secured to the said vehicle body 1 and a pair of rotary shafts 13, each of which extends in a forward and rearward direction in a horizontal plane and is supported so as to be rotatable. The said pair of rotary shafts 13 are adapted to be rotationally driven by a hydraulic motor 14, and it is a hopper 15 that is mounted on the upper part of the said housing 11. Crushable objects which are cast into the said hopper 15 are then charged through a charging inlet 16 at the upper part of the said housing 11 into the latter and, with the said pair of rotary shafts 13 being rotated, are allowed to be crushed to yield crushed pieces. The crushed pieces are discharged through a discharge outlet formed in the bottom of the said housing 11 and are then allowed to drop onto the above mentioned belt conveyer 8.

(The Detailed Structure of the Crushing Machine)

Figure 3:
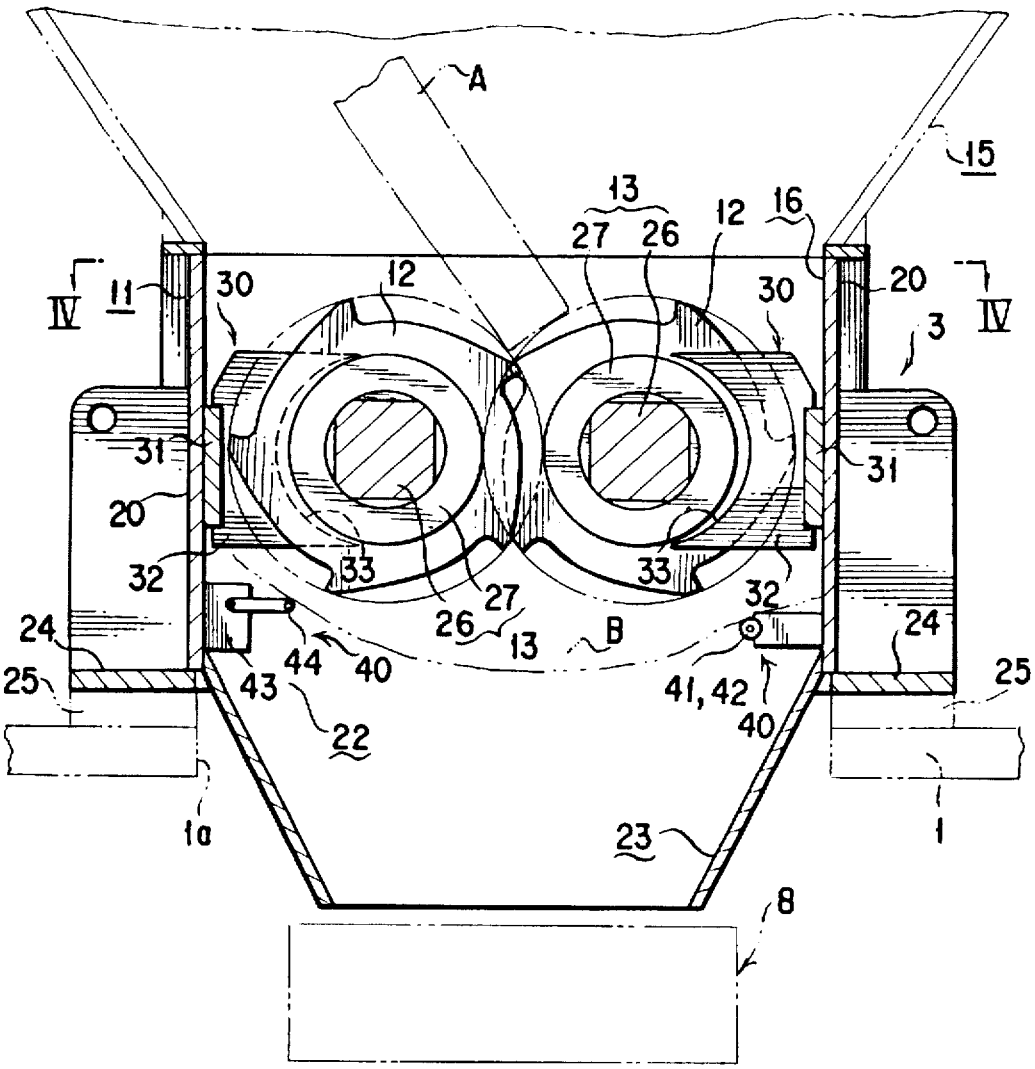
FIG. 3 is a vertical cross sectional view showing in detail a crushing machine to which the above mentioned embodiment of the present invention is applied.
Figure 4:
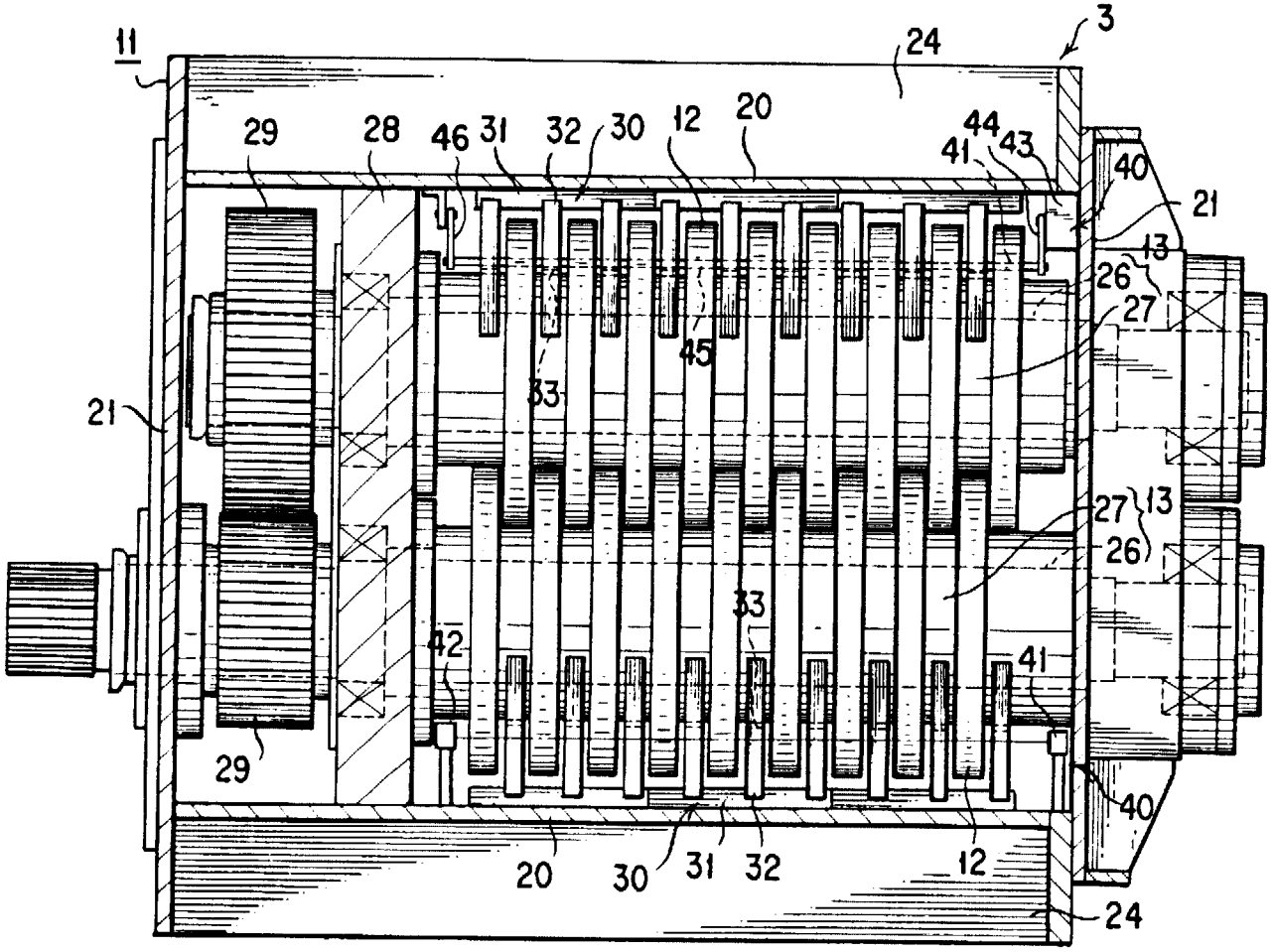
FIG. 4 is a horizontal cross sectional view showing in detail the above mentioned embodiment of the present invention.

As shown in FIGS. 3 and 4, the said housing 11 is constituted of a first pair of vertical plates 20 and 20 which are opposing to each other and a second pair of vertical plates 21 and 21 which are opposing to each other. And, the said housing 11 is in the form of a box having the said charging inlet 16 at its upper side and the said discharge outlet 22 at its lower side, with the said discharge outlet 22 having a discharge shoot 23 appended thereto. Also, in order to fixedly secure the said housing 11 to the said vehicle body 1, a pair of fixing plates 24 which are fastened to the above mentioned lower side of the said pair of vertical plates 20, are affixed to the rim portion of an opening la of the said vehicle body 1 via a pair of elastic members 25, respectively.

The above mentioned rotary shafts 13 are each comprised of a shaft 26 and a plurality of collars 27 while a plurality of cutters 12 are each fittedly inserted between such adjacent collars 27 and mounted on a said shaft 26. The said shafts 26 are supported sidelong, so as to extend in parallel to each other and to be each rotatable, between a partition wall 28 and one of the said second vertical plates 21. And, the said cutters 12 which are mounted on said pair of rotary shafts 13, are arranged so as to overlap with one another in their axial directions. Furthermore, a pair of shafts 26 as mentioned above are coupled so as to be mutually oppositely rotated by a pair of gears 29 which are mounted to them, respectively, and which are meshed with each other. Here, one of the said shafts 26 is arranged so as to be driven by the above mentioned hydraulic motor 14.

There are also provided scrapers 30 each of which is mounted to the inner surface of each of the said first pair of vertical plates 20, respectively. Such a plurality of scrapers 30 are secured to each of mounting plates 31 which are spaced from each other, and include a plurality of plates 32, respectively, which in turn are spaced from each other. Each of the said plates 32 has an arcuate recess 33 that is substantially identical in diameter to each of the said collars 27. And, it is so configured that if each of the said mounting plates 31 is fastened to the inner surface of each of the said first vertical plates 20 by means of a bolt or the like, each of the plates 32 may project between the said adjacent cutters 12, there may then be a spacing between each of the said cutters 12 and each of the said plates 32, and there may likewise be a spacing between the said arcuate recess 33 of each of those plates 32 which are opposing to each other and each of the said collars 27. In other words, said scrapers are mounted so that there may be provided a spacing between said scrapers and said crushing means (i. e. the said pair of rotary shafts 13 which are provided with the said cutters 12).

It should be noted at this point that said scrapers 30 may comprise a plurality of plates 32.

With the said crushing machine 3 being constituted in this fashion, if a light weight crushable object A such as a straw mat is cast between a pair of the cutters 12 and 12 from the said charging inlet side as shown in FIG. 3 and then crushed, crushed pieces B will be pushed into a spacing between the said plate 32 and the said cutter 12 and into a spacing between the said arcuate recess 33 of the plate 32 and the said collar 27 so as to cause clogging in said spacing. As a result, as shown by the phantom line in FIG. 3, there may develop a situation in which the said crushed pieces B will successively be piled or deposited at the discharging side and will thus be incapable of dropping and being discharged.

Thence, in order to obviate this difficulty, an arrangement is made in which at a site downwards of said scrapers 30 in the inner surface of a said first vertical plate 20 of the above mentioned housing 11, there is provided a crushed pieces deposit detecting means 40 that is designed to detect that the said crushed pieces B have been piled to a given degree at the said discharging side as mentioned above.

The said crushed pieces deposit detecting means 40 may have a construction in which as shown in FIGS. 3 and 4 a light emitter 41 and a light receiver 42 are mounted spacedly opposed to each other in the axial direction of a said rotary shaft 13 so that if a light beam from the said light emitter 41 is interrupted by the piled or depositing crushed pieces B, the said means may furnish at its output a signal that is indicative of such a pile or deposition of the said crushed pieces.

Also, the said crushed pieces deposit detecting means 40 may have a configuration in which as shown in FIGS. 3 and 4, a limit switch 43 is mounted on one side of the inner surface of a said vertical plate 20 of the above mentioned housing 11, an arm 46 is supported on the other side of the said first vertical plate 20 so as to be capable of being swung, and one end of a transverse rod 45 extending in the axial direction of a said rotary shaft 13 is coupled to a movable piece 44 of the said limit switch 43 while its other end is coupled to the said arm 46. Thus, the said means 40 can be so configured that if the said transverse rod 45 is pushed downwards by the said crushed pieces B which has been piled, the said limit switch 43 may be turned ON to generate a signal that is indicative of a pile or deposition of the said crushed pieces B.

Now, an explanation will be given with respect to a first embodiment of the crushing machine driving apparatus according to the present invention, in connection with which an explanation will also be given with respect to a crushing machine driving method according to the present invention.

(A Driving Apparatus for the Crushing Machine)

Figure 5:
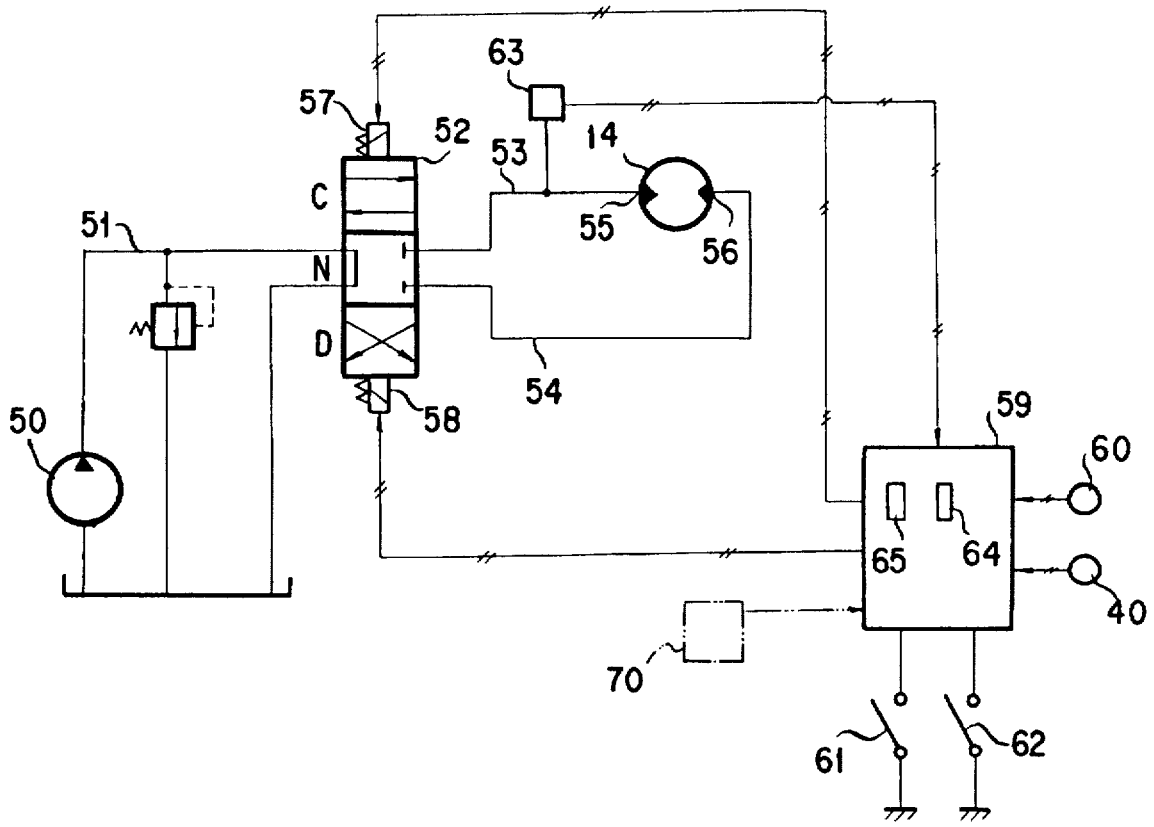
FIG. 5 is a constructive explanatory view of the above mentioned embodiment of the present invention.

As shown in FIG. 5, a discharge path 51 of a hydraulic pump 50 is arranged so as to be selectively connected to one of a first and a second main circuit 53 and 54 via a directional control valve 52. The said main circuit 53 is connected to a normal rotation port 55 of the above mentioned hydraulic motor 14 whereas the said second main circuit 54 is connected to a reverse rotation port 56. And, when the said directional control valve 52 is switched from its neutral position N to a normal rotation position C thereof, the said first main circuit 53 will be supplied with a pressure fluid to cause the said hydraulic motor 14 to be rotated normally. If it is switched to a reverse rotation position D thereof, the said second main circuit 54 will be supplied with the pressure fluid to cause the said hydraulic motor 14 to be rotated reversely. Further, if the said directional control valve 52 is held at the said neutral position N, the pressure fluid will be supplied to neither the said first main circuit 53 nor the second main circuit 54, thereby halting the said hydraulic motor 14.

The above mentioned directional control valve 52 is normally held at the said neutral position N, will be switched to the said normal rotation position C if a first solenoid 57 has an electric current passed therethrough, and will be switched to the said reverse rotation position D if a second solenoid 58 has an electric current passed therethrough. These electric currents passed through the said first and second solenoids 57 and 58 are controlled by means of a controller 59.

Into the above mentioned controller 59, there are furnished at its inputs an automatic signal from an automatic switch 60, an activation signal from a manually actuated switch 61, a reverse rotation signal from a manually actuated reverse rotation switch 62, a pressure detection signal from a pressure switch 63 provided in the above mentioned first main circuit 53, and a crushed pieces deposit detection signal from the above mentioned crushed pieces deposit detecting means 40. And, the said controller 59 is provided with a first timer 64 and a second timer 65.

An explanation will next be given with an operation of the above mentioned first embodiment of the present invention.

(When the Controller 59 is Furnished at an Input Thereof with an Automatic Signal from the Automatic Switch 60)

The said controller 59 is then adapted to magnetically energize the said solenoid 57 with an electric current passed therethrough to set the said directional control valve 52 at the said positive rotation position C, thereby permitting the pressurized discharge fluid from the said hydraulic pump 50 to be delivered to the said first main circuit 53 to rotate the said hydraulic motor 14 in a normal direction.

The said pair of rotary shafts 13 will be thereby rotated normally to cause crushable objects to be crushed.

In a crushing operation, if a light weight crushable object A such as a straw mat is crushed and the crushed pieces B are piled at their discharging side of said pair of rotary shafts 13, the said controller 59 will be furnished at an input thereof from the said crushed pieces deposit detecting means 40 with a signal that is indicative a pile or deposition of the crushed pieces B.

Thence, the said controller 59 will magnetically deenergize the said first solenoid 57 and will cause an electric current to be passed through the said second solenoid 58 to magnetically energize the latter and then to set the said directional control valve 52 to the said reverse rotation position D, thereby permitting the pressurized discharge fluid from the said hydraulic pump 50 to be fed into the said second main circuit 54 to rotate the said hydraulic motor 14 in a reverse direction.

The said pair of rotary shafts 13 will thereby be rotated reversely to feed out the crushed pieces which have been pushed into the spacing between the said crushing means and the said scraper 30, thereby permitting the said crushed pieces B which have been piled or deposited to drop entirely and then to be discharged.

Concurrently with such reverse rotations, the said second timer 65 will be operated. If the said second timer 65 is timed out after a predetermined lapse of time (e. g., around 5 seconds), the said second solenoid 58 will be magnetically deenergized and at the same time the said first solenoid 57 will be magnetically energized to switch the said directional control valve 52 to the said normal rotation position C, thereby causing the said pair of rotary shafts 13 to be rotated normally to crush the crushable object A as mentioned previously.

In the preceding operation, if the pressure in the said first main circuit 53 exceeds a preset pressure, a pressure detection signal will be furnished from the output of the said pressure switch 63. In response to the said signal, the controller 59 will act to magnetically deenergize the said first solenoid for a predetermined lapse of time (e. g., 3 seconds) and also to have an electric current passed through the second solenoid 58 to magnetically energize the latter, thereby switching the said directional control valve 52 to the said reverse rotation position D. As mentioned previously, however, said pair of rotary shafts 13 will be rotated reversely and, after said predetermined lapse of time, will be rotated normally. Therefore, this arrangement is capable of meeting with the case in which the crushable object A has been clogged at the charging inlet side of the said crushing means (i. e. the said pair of shafts 13 which are provided with the said cutters 12).

In other words, if the crushable object A is clogged at the charging inlet side of the said crushing means, it has been shown that since there results a greater rotary load applied to the said rotary shafts 13, which in turn causes an excessive force to be applied to each of different portions of the system, there may develop a situation in which the said crushing means will be broken or will eventually become halted. If the present invention is adopted, however, in which if an excessive load acts on the said hydraulic motor 14 such that the pressure in the said first main circuit 53 may exceed a preset pressure, it follows that a pressure detecting signal will be furnished from the said pressure switch 63 and the said controller 59 will then be responsive to the said pressure detecting signal to reversely rotate the said pair of rotary shafts 13 for a predetermined time duration. Hence, it will become possible to discharge the crushable object A that has been clogged at the said charging inlet side.

(When the Controller 59 is Not Furnished at an Input Thereof with an Automatic Signal from the Automatic Automatic Switch 60)

When the said controller 59 is furnished at an input thereof with the activation signal from the said manually actuated switch 61, it will have an electric current passed through the said first solenoid 57, thereby magnetically energizing the same to switch the said directional control valve 52 to the said normal rotation position C. Thus, as in the case mentioned above, the said pair of rotary shaft 13 will be rotated normally to crush the crushable object A. If a situation will develop in which the said controller 59 is not furnished at the said input thereof with the said activation signal, it will magnetically deenergize the said first solenoid 57 to switch the said directional control valve 52 to the said neutral position N. Hence the said pair of rotary shafts 13 will then be halted.

When the said controller 59 is furnished at an input thereof with the reverse rotation signal from the said manually operated reverse rotation switch 62, it will have an electric current passed through the said second solenoid 58, thereby magnetically energizing the latter to switch the said directional control valve 52 to the said reverse rotation position D. If the crushed pieces B have then been clogged in the spacing between the said crushing means and said scrapers 30, they will be discharged. If there then develops a situation in which the said controller 59 is not furnished at the said input thereof with the said reverse rotation signal, it will magnetically deenergize the said second solenoid 58 to switch the said directional control valve 52 to the said neutral position N. Hence the said pair of rotary switch 13 will then be halted, here again.

An explanation will now be given with respect to a second embodiment of the crushing machine driving apparatus according to the present invention.

It should be noted that its construction is substantially identical to that of the above mentioned first embodiment, except that the crushed pieces deposit detection means 40 is not provided.

An explanation will next be given in regard to an operation of the second embodiment of the present invention.

(When the Controller 59 is Furnished at an Input Thereof with the Automatic Signal from the Automatic Switch 60)

The said controller 59 will then have an electric current passed through the said first solenoid 57 to magnetically energize the same, thereby switching the said directional control valve 52 to the said normal rotation position C. The said first main circuit 53 will then be delivered with the pressurized discharge fluid from the said hydraulic pump 50 to rotate the said hydraulic motor 14 in the normal direction.

The said pair of rotary shafts 13 will thereby be rotated normally to crush the crushable object A.

Concurrently with such normal rotations, the said first timer 64 will be operated. If the said first timer 64 is timed out after a predetermined lapse of time (e. g., 30 seconds later), the said first solenoid 57 will be magnetically deenergized and at the same time the said second solenoid 58 will have an electric current passed therethrough to magnetically energize the same, thereby switching the said directional control valve 52 to the said reverse rotation position D. The pressurized discharge pressure of the said hydraulic pump 50 will then be fed to the said second main circuit 54 to rotate the said hydraulic motor 14 in the reverse direction.

The said pair of rotary shafts 13 will thereby be rotated reversely and if the crushed pieces B has been pushed into the spacing between the said crushing means and said scrapers 30, the said crushed pieces B will be fed out so as to drop and to be discharged.

Concurrently with such reverse rotations, the said second timer 65 will be operated. If the said second timer 65 is timed out after a predetermined lapse of time (e. g., 5 seconds later), the said second solenoid 58 will be magnetically deenergized and at the same time the said first solenoid 57 will have an electric current passed through it to magnetically energize the same. The said directional control valve 52 will then be switched to the said normal rotation position C, thereby rotating the said pair of rotary shafts 13 normally to cause the crushable object A to be crushed as in the previously mentioned case.

Thereafter, as mentioned previously, after the said hydraulic motor 14 is rotated in the normal direction for a first predetermined time duration, it will be rotated in the reverse rotation for a second predetermined time duration and, thereafter, will again be rotated in the normal direction for the said first predetermined time duration. By repeating this cycle, the said pair of rotary shafts 13 in the said crushing machine 3 will be rotated in the normal directions for the said first predetermined direction and in the reverse directions for the said second predetermined time duration, iteratively. It should be noted at this point that the said first predetermined time duration is set to be longer than the said second predetermined time duration.

By doing so, it will be seen that since the crushed objects which have been pushed into the spacing between the said crushing means and said scrapers 30 can automatically be discharged and dropped, the deposition or pile of a plenty of crushed pieces B at the discharge side will be eliminated.

During the foregoing operation, if the pressure in the first main circuit 53 exceeds a preset pressure, a pressure detecting signal will be furnished from the output of the said pressure switch 63. The said controller 59 will then be responsive to the said pressure detecting signal for magnetically deenergizing the said first solenoid 57 for a predetermined time duration (e. g., 3 seconds) and at the same time for passing an electric current through the said second solenoid 58 to magnetically energize the same, thereby switching the said directional control valve 52 to the said reverse rotation position D. As mentioned previously, this will cause the said pair of rotary shafts 13 to be rotated reversely and, after a predetermined lapse of time, to be rotated normally. Thus, the apparatus described will also be able to fully meet with the situation in which a crushable object A has been clogged at its charging inlet side.

In other words, if a crushable object A has been clogged at its charging inlet side of the said crushing means, the said pair of rotary shafts 13 will be reversely rotated for a predetermined time duration using the same principle as in the first mentioned embodiment to allow the said crushable object A that has been clogged at its charging inlet side to be successfully discharged.

And, if an excessive load for the said hydraulic motor 14 is detected and the said hydraulic motor 14 is then reversely rotated as in the foregoing, it will be seen that the above mentioned first timer 64 can be cleared and, thereafter, when the said hydraulic motor 14 is normally rotated, the said first timer 64 can again commence operating.

It should be noted at this point that the amount of crushed pieces B which have been pushed into and held within the spacing between the said crushing means and a said scraper 30 may vary depending on natures (i. e. material and shape) of the said crushed pieces B and therefore it is preferred that the time duration of the said normal rotation and the time duration of the said reverse rotation of the said pair of rotary shafts 13 should be set in accordance with such natures of the said crushed pieces B.

For this reason, as shown by the phantom line in FIG. 5, there is provided a timer preset time duration changing means 70 that is designed to alter the preset time durations of the said first and second timers 64 and 65, i. e. the said first and second predetermined time durations and that can be operated by a crushing machine user for changing the said first and second predetermined time durations in accordance with the natures of the crushed pieces B.

Figure 6:
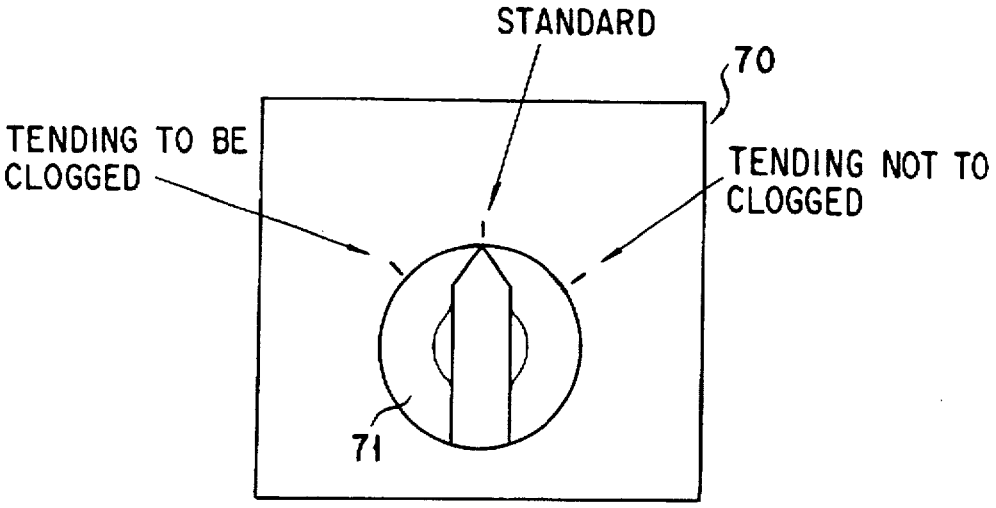
FIG. 6 is an explanatory view of an example of the means for changing a timer preset time duration, that can be used in the above mentioned embodiment of the present invention.

The above mentioned timer preset time changing means 70 can, as shown by way of an example in FIG. 6, be of an analog type in which if a dial 71 is turned from a "standard" position to a "tending to be clogged" position, the said first time duration for the said normal rotation may be relatively decreased and the said second time duration for the said reverse rotation may be relatively increased and in which if the said dial 71 is turned from the "standard" position to a "tending not to be clogged" position, the said first time duration for the said normal rotation may be relatively increased and the said second time duration for the said reverse duration may be decreased relatively.

Figure 7:
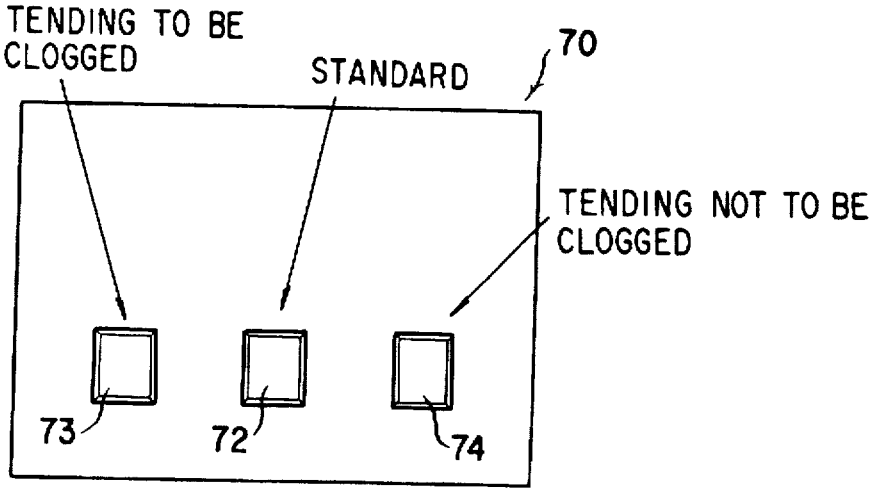
FIG. 7 is an explanatory view of another example of the timer preset time duration changing means for use in the above mentioned embodiment of the present invention.

As shown in FIG. 7, the above mentioned changing means 70 can also be of a digital type which is provided with a standard button 72, a "tending to be clogged" button 73 and a "tending not to be clogged" button 74 and in which if the said "tending to be clogged" button 73 is depressed, the said first time duration for the said normal rotation is set to be relatively short and the said second time duration for the said reverse rotation is set to be relatively long and in which if the said "tending not to be clogged" button 74 is depressed, the said first time duration for said normal rotation is set to be relatively long and the said second time duration for the said reverse rotation is set to be relatively short.

While each of the above mentioned embodiments makes use of the said hydraulic pump 50 and the hydraulic motor 14, it should be noted that they alternatively make use of a power supply and an electric motor.

As set forth in the foregoing description, according to a driving method of the present invention, it can be seen that since a pair of rotary shafts are adapted to be driven in a normal rotation and a reverse rotation repetitively, if crushed pieces resulting from the crushing of a crushable object are pushed into and held within a spacing between the said crushing means and said scrapers 30, they can be discharged automatically from the said spacing and a continuous crushing operation is made possible since the time duration for the said reverse rotation is set to be shorter than the time duration for the said normal rotation.

Accordingly, there can in no way develop a situation in which crushed pieces are piled or deposited at the discharge side of the crushing means so as to become incapable of dropping or being discharged, and a crushing operation can be carried out efficiently.

Also, if the first time duration for the normal rotation and the second time duration for the reverse rotation are each made variable, it can be seen that both the normal rotation time duration and the reverse rotation time duration can adaptively be obtained in accordance with the nature of crushed pieces and hence a crushing operation that is adjusted in accordance with the nature of the crushed pieces can be made into a reality and a crushing operation with an enhanced efficiency can be carried out.

Also, according to a driving apparatus of the present invention, it can be seen that since a pair of rotary shafts are automatically rotated reversely, when crushed pieces are piled or deposited at the discharge side of the crushing means, to discharge the crushed pieces which have been pushed into and held within the spacing between the crushing means that has been a cause of the pile or deposition and a scraper, the piled or depositing crushed pieces can be dropped and discharged effectively. Therefore, the conventional inability for crushed pieces piled or depositing at the discharge side of the crushing means to drop and be discharged can effectively be eliminated.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A method of driving a dual axis shearing type crushing machine mounted on a self-traveling vehicle body for crushing crushable building scraps at a building wrecking site, said crushing machine including a pair of rotary shafts provided with a plurality of cutters within a housing on said vehicle body, said rotary shafts being supported sidelong so as to be concurrently rotatable, and said crushing machine including a scraper attached to an inner surface of said housing on said vehicle body so as to oppose said cutters and said rotary shafts, said method comprising the steps of:

a) rotating said pair of rotary shafts in a forward direction for a first predetermined time duration so that said cutters crush said crushable building scraps into crushed pieces;

b) thereafter rotating said pair of rotary shafts in a reverse direction for a second predetermined time duration so that said crushed pieces are drawn into and trapped in a spacing provided between said scraper and said cutters and said rotary shafts at an outlet side of said crushing machine within said housing; and c) continuously repeating the steps a) and b) in succession so as to consecutively crush said crushable building scraps into said crushed pieces and force said crushed pieces to be fed from said outlet side of said crushing machine out of said housing so as to enable said crushed pieces to be discharged onto a conveyor provided on said vehicle body without clogging of said crushed pieces in said spacing, said first predetermined time duration being set to be longer than said second predetermined time duration.

2. A method of driving a crushing machine as set forth in claim 1, wherein said first predetermined time duration and said second predetermined time duration are variable.

3. A method of driving a crushing machine as set forth in claim 2, further comprising reversely rotating said pair of rotary shafts for a third predetermined time duration when an excessive load is applied to said crushing machine, said third predetermined time duration differing from both said first and second predetermined time durations.

4. A method of driving a crushing machine as set forth in claim 1, further comprising reversely rotating said pair of rotary shafts for a third predetermined time duration when an excessive load is applied to said crushing machine, said third predetermined time duration differing from both said first and second predetermined time durations.

5. An apparatus for driving a dual axis shearing type crushing machine mounted on a self-traveling vehicle body for crushing crushable building scraps at a building wrecking site, said crushing machine including a pair of rotary shafts provided with a plurality of cutters within a housing on said vehicle body, said rotary shafts being supported sidelong so as to be concurrently rotatable, and said crushing machine including a scraper attached to an inner surface of said housing on said vehicle body so as to oppose said cutters and said rotary shafts, said apparatus comprising:

a drive source for switchably driving said rotary shafts in a first driving mode in which said rotary shafts are driven in a forward direction so that said cutters crush said crushable building scraps into crushed pieces, a second driving mode in which said rotary shafts are driven in a reverse direction so that said crushed pieces are drawn into and trapped in a spacing provided between said scraper and said cutters and said rotary shafts at an outlet side of said crushing machine within said housing, and a third driving mode in which rotation of said rotary shafts is halted;

a crushed pieces deposit detector for detecting that a pile of said crushed pieces has been created at said outlet side of said crushing machine; and a controller for causing said drive source to drive said rotary shafts in said first driving mode when an activation signal is furnished at an input of said controller, and for causing said drive source to drive said rotary shafts in said second driving mode when said crushed pieces deposit detector outputs a pile detection signal, thereby forcing said crushed pieces piled at said outlet side to be fed from said outlet side of said crushing machine out of said housing so as to enable said crushed pieces to be discharged onto a conveyor provided on said vehicle body without clogging of said crushed pieces in said spacing.

6. An apparatus for driving a crushing machine as set forth in claim 5, wherein said controller is adapted to continuously and repeatedly cause said drive source to drive said rotary shafts in said first driving mode for a first predetermined time duration when an automatic signal is furnished at said input thereof, and thereafter in said second drive mode for a second predetermined time duration, said first predetermined time duration being longer than said second predetermined time duration.

7. An apparatus for driving a crushing machine as set forth in claim 6, wherein said controller is provided with a first timer and a second timer for variably establishing said first predetermined time duration and said second predetermined time duration.

8. An apparatus for driving a crushing machine as set forth in claim 7, further comprising a detector for detecting an excessive load applied to said crushing machine, and wherein said controller is adapted to cause said drive source to drive said rotary shafts in said second drive mode for a third predetermined time duration when said detector detects said excessive load, said third predetermined time duration differing from said first and second predetermined time durations.

9. An apparatus for driving a crushing machine as set forth in claim 6, further comprising a detector for detecting an excessive load applied to said crushing machine, and wherein said controller is adapted to cause said drive source to drive said rotary shafts in said second drive mode for a third predetermined time duration when said detector detects said excessive load, said third predetermined time duration differing from said first and second predetermined time durations.

* * * * *